United States Patent [19]

Simon et al.

[11] Patent Number: 4,842,197

[45] Date of Patent: Jun. 27, 1989

[54] FUEL INJECTION APPARATUS AND ASSOCIATED METHOD

[75] Inventors: Burkhard Simon, Röhrmoos; Franz Joos, Munich, both of Fed. Rep. of Germany

[73] Assignee: MTU Motoren-und Turbinen-Union GmbH, Munich, Fed. Rep. of Germany

[21] Appl. No.: 131,206

[22] Filed: Dec. 10, 1987

[30] Foreign Application Priority Data

Dec. 10, 1986 [DE] Fed. Rep. of Germany ..... 3642122

[51] Int. Cl.[4] ..... F23D 11/24; F02C 7/232; F23R 3/28

[52] U.S. Cl. ..... 239/5; 239/8; 239/400; 239/403; 239/406

[58] Field of Search ..... 239/5, 8, 400, 402, 239/403, 404, 405, 406

[56] References Cited

U.S. PATENT DOCUMENTS

| | | | |
|---|---|---|---|
| 3,254,846 | 6/1966 | Schreter et al. | 239/400 |
| 3,703,259 | 11/1972 | Sturgess et al. | 239/400 |
| 3,912,164 | 10/1975 | Lefebre et al. | 239/5 |
| 3,972,182 | 8/1976 | Salvi | 239/406 X |

FOREIGN PATENT DOCUMENTS

| | | | |
|---|---|---|---|
| 434170 | 11/1974 | U.S.S.R. | 239/403 |

*Primary Examiner*—Andres Kashnikow

*Attorney, Agent, or Firm*—Roberts, Spiecens & Cohen

[57] ABSTRACT

A fuel injection device having three concentric streams of air for the atomization of fuel sprayed onto a sleeve by an injector facing into the sleeve. The inner and outer streams of air are imparted with swirl in opposite direction, while the central stream of air is free of swirl. The two inner streams of air atomize the fuel as a result of shear forces, while the outer stream of air forms a stable recirculation region in a combustion chamber into which the fuel injector device extends.

13 Claims, 3 Drawing Sheets

FUEL INJECTION APPARATUS AND ASSOCIATED METHOD

FIELD OF THE INVENTION

The present invention relates to fuel injection apparatus for the combustion chamber of a gas turbine for mixing fuel and compressed air, and particularly to such apparatus comprising a sleeve arranged downstream of an injection nozzle to form a film of fuel thereon and inner and outer air-feed devices for supplying two streams of air of oppositely directed swirl around the sleeve for atomizing the fuel at a discharge edge of the sleeve.

The invention further relates to an associated method of fuel injection.

DESCRIPTION OF PRIOR ART

A fuel injection apparatus of the above type is known from U.S. Pat. No. 3,703,259, in which an injection nozzle is annularly surrounded by an axial air-feed device which imparts swirl in the circumferential direction to an axial stream of air. By this swirl and the swirl in the same direction imparted to the fuel by the injection nozzle, a large part of the fuel is thrown onto the inner surface of a downstream sleeve where it forms a film of fuel. Another air-feed device which is arranged radially outside of the sleeve imparts to a second stream of air a swirl in a direction opposite the stream of air flowing within the sleeve. In this way, the film of fuel present at the terminal edge of the sleeve is atomized by a turbulent shear layer of the oppositely directed concentric streams of air.

With high compression of the air fed, the cone angle of the sprayed fuel becomes very large as a result of the strong swirl of the outer stream of air and the main mass of the fuel is conveyed correspondingly far radially outward. In this way, too much fuel can come into the vicinity of the rear wall of the flame tube as a result of which overheating thereof or else a build-up of carbon can take place, depending on the supply of air present.

Furthermore, due to the interaction of the concentric streams of air, instabilities can result, due to which a swirl-induced recirculation region developed within the combustion chamber may suddenly collapse.

One possible way of avoiding this phenomena is to lengthen the sleeve with the terminal edge. As a result, however, there would be a turbulent region on the outer surface of the terminal edge since the outer air stream, due to its swirl, would lie against its outer channel wall. In this case there would be formed in the turbulent region a ring of fuel from which, from time to time, large drops of fuel would be thrown radially outward. Furthermore, the drops produced would become larger and lead to poorer combustion behavior.

On the other hand, if the cone angle of the sprayed fuel is too small then a longer primary zone of combustion will result, as a consequence of which a poorer outlet temperature distribution and a poorer degree of burning will be obtained.

SUMMARY OF THE INVENTION

An object of the present invention is to provide a fuel injection apparatus and associated method which avoid the aforenoted disadvantages and which will, at high compressor pressure ratios, spray highly atomized fuel, at a suitable average angle, preferably within the range of 50° to 80° with respect to the center axis to provide a swirl-induced recirculation flow in the combustion chamber.

In accordance with the invention, this object is attained in that the sleeve of the fuel injection apparatus is constructed as a nozzle and between the inner air-feed device and the outer air-feed device there is provided a central air-feed device whose air channel has a cross section which tapers in narrowing fashion in the direction of flow, with the narrowest cross section at a terminal edge of the sleeve and which supplies radially outside the sleeve and radially inside the outer air-feed device, a stream of air which flows without turbulence around the terminal edge of the sleeve.

By the introduction of the third stream of air, the previous two-fold function of the outer swirl flow, namely to induce a recirculation region in the flame tube and to atomize the fuel by outer flow over the terminal edge, is separated. The radially outermost air-feed device induces, in this respect, the build up of a stable recirculation region which, after the discontinuous widening in cross section of the injection device into the flame tube, fills up, free of turbulence, even the corners of the head of the flame tube due to the radial outflow of the stream of air.

The atomization of the fuel sprayed onto the sleeve is effected by the cooperation of the swirling stream of air flowing within the sleeve with the third stream of air conveyed by the central air-feed device according to the invention, said third stream of air flowing smoothly without swirl or turbulence around the terminal edge of the sleeve from the exterior at high velocity of flow. In this regard, the high velocity of flow is due to the fact that the cross section of the air channel of the central air-feed device tapers in narrowing fashion in the direction of flow.

One essential advantage of the injection apparatus of the invention is that the terminal edge for the film of fuel is traversed on both sides without turbulence and a fine atomization of the fuel is obtained.

According to a further feature of the invention, the sleeve forming the outer shell of the air-feed device of the invention is extended further into the combustion chamber than the sleeve which forms the inner shell. In this way, the mixing of the two fuel-laden inner flows and the outer flow is further delayed.

Another feature of the invention resides in the arrangement in which the swirl blades of the inner air-feed device are arranged downstream of the injection nozzle. This has the advantage that the entire fuel injection apparatus is smaller for the same throughput of air and in this way can be integrated firmly in the flame tube of the combustion chamber. Furthermore, in this way it is possible for the injection nozzle to be provided with one or more radial outlets spaced around its periphery since the fuel only needs to be admixed into the stream of air. The production of the swirl for air and fuel is obtained by the swirl blades which are arranged downstream. In this way, the injection nozzle, which heretofore had been difficult and expensive to manufacture due to the swirl-producing device, can be greatly simplified in advantageous manner.

BRIEF DESCRIPTION OF THE FIGURES OF THE DRAWING

Preferred embodiments of the invention will be described in further detail hereafter, with reference to the accompanying drawing, in which.

DETAILED DESCRIPTION OF PREFERRED EMBODIMENTS

Figure 1:
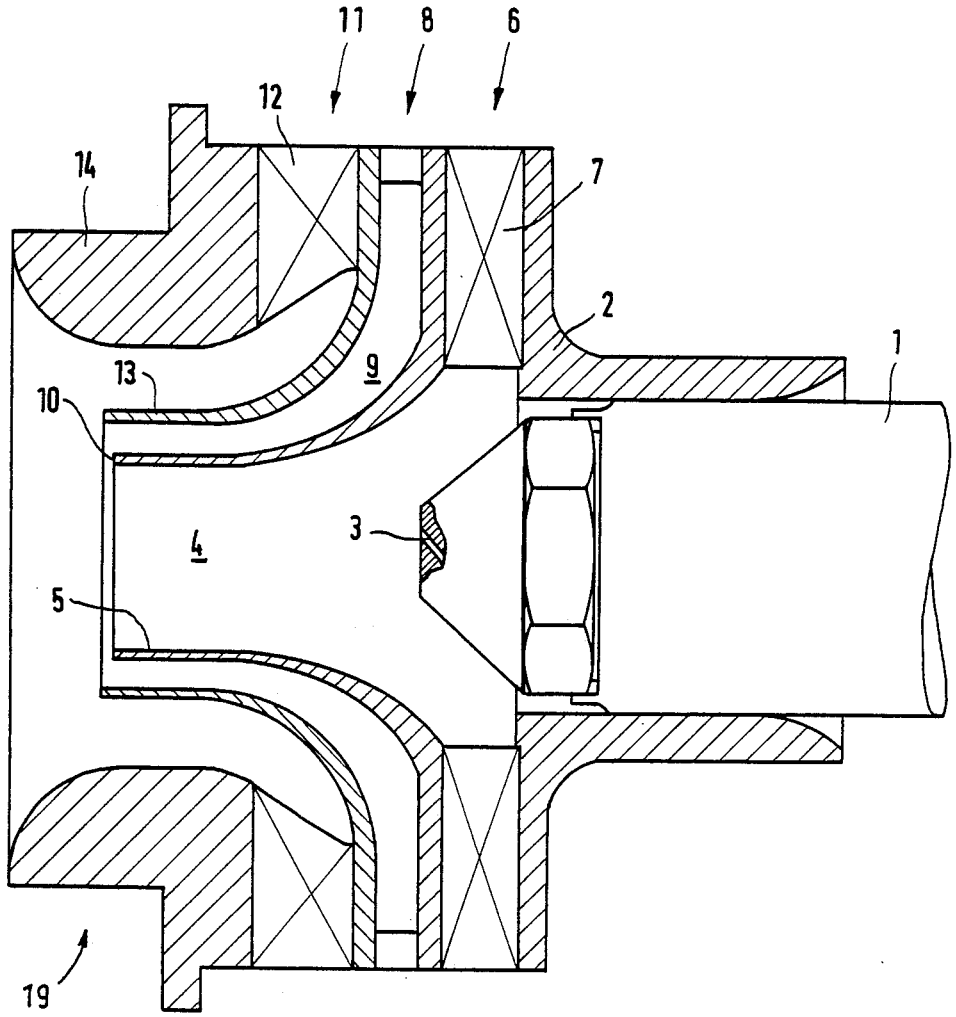
FIG. 1 is a longitudinal sectional view through a first embodiment of fuel injection apparatus according to the invention.
Figure 2:
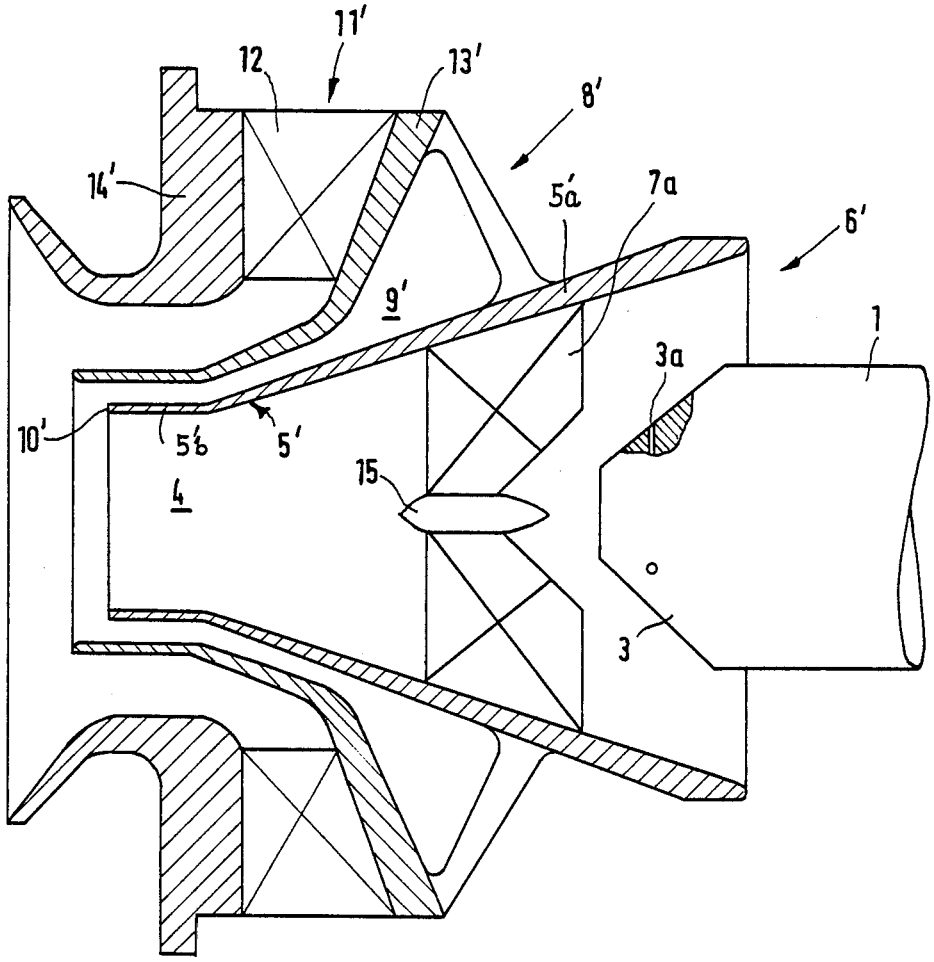
FIG. 2 is a longitudinal sectional view through another embodiment of the fuel injection apparatus.

FIG. 1 shows a fuel injection device 19 which comprises an injection nozzle 1 arranged in a housing 2. At the front part of the nozzle 1 there are provided one or more injection openings 3 which spray fuel into an air channel 4 and onto the wall of a sleeve 5 which defines air channel 4. The injection openings 3 can be so arranged that the fuel is injected with swirl or, as shown in FIG. 2, they can be formed as radial injection openings 3*a*.

Radially outside of the injection openings 3 there is an inner air-feed device 6 through which a stream of air flows radially inward into the air channel 4. In this respect, a swirl in the circumferential direction is imparted to the stream of air by swirl producers 7 distributed around the periphery. The swirl producers 7 can be in the form of blades or air channels.

A central air-feed device 8 also conveys a stream of air radially inward and the air is then deflected, in axial direction and flows externally around the sleeve 5. The cross section of the annular air channel 9 of the central air-feed device 8 decreases in the direction of flow, with the narrowest cross section at the terminal edge 10 of the sleeve 5.

An outer air-feed device 11 is arranged to introduce a third stream of air in axial direction radially outside the other two streams of air. The third stream of air is imparted with a swirl in the circumferential direction, by swirl producers 12, which is opposite to the direction of swirl of the air stream present in the air channel 4. The sleeve 13 which separates the central air-feed device 8 from the outer air-feed device 11 extends, in the embodiment shown in FIG. 1, further into the combustion chamber than the concentrically positioned inner sleeve 5. The sleeve 5 tapers in nozzle-like manner in the downstream direction and as shown in FIG. 1 includes a tubular portion at its terminal edge 10 which is axially disposed downstream of the injection nozzle.

The inner surface of a front housing portion 14 curves outwardly in funnel shape downstream of the sleeve 13.

FIG. 2 shows another embodiment of the fuel injection apparatus in which elements corresponding to those in FIG. 1 will be designated with primes. In FIG. 2 the inner air-feed device 6' feeds its stream of air substantially in axial direction around the injection nozzle 1. A swirl producer 7*a* of the inner air-feed device 6' is arranged downstream of injection openings 3*a* of the injection nozzle 1, the injection openings 3*a* being formed as radial outlets distributed over the circumference of the nozzle 1. The swirl producer 7*a* has a central body 15 in the vicinity of the axis of the nozzle 1.

The sleeve 5' has a portion 5'*a* which tapers conically in the downstream direction and is connected to a cylindrical portion 5'*b* formed with the terminal edge 10'. The sleeve 13' which together with the concentrically disposed inner sleeve 5 forms the annular air channel 9', tapers conically at a greater cone angle than the sleeve 5', so that air channel 9' has a decreasing cross section in the direction of flow. The decrease in cross section is initially great at the inlet of channel 9' but then is decreased in the central and downstream regions.

Figure 3:
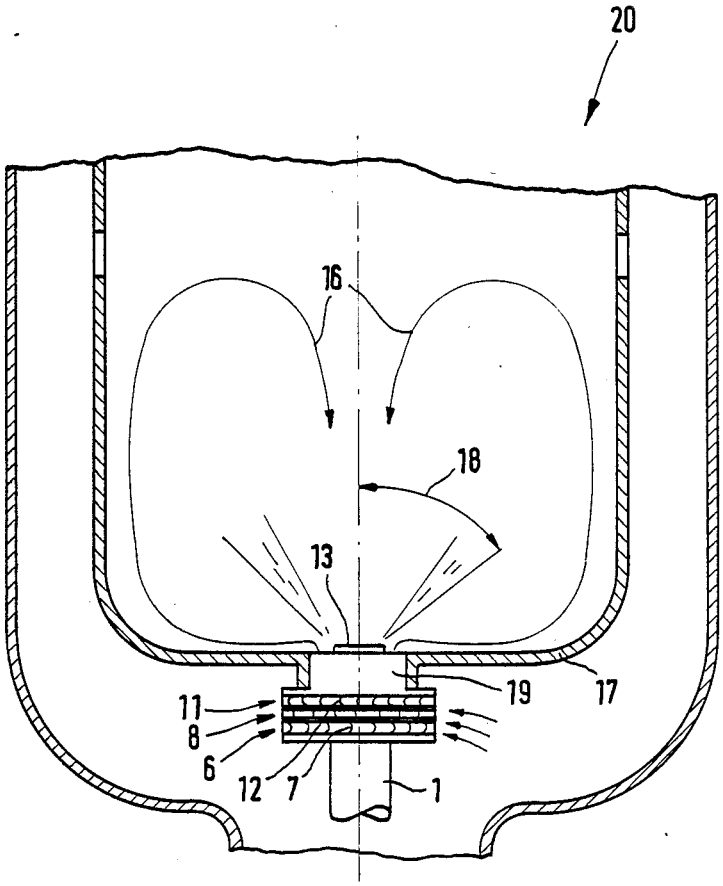
FIG. 3 is a diagrammatic illustration of the recirculation flow in a combustion chamber.

In operation, fuel is sprayed through the injection openings 3 or 3*a* into the air channel 4, the fuel being propelled by its inherent swirl and by the swirling air flow conveyed by the air-feed device 6 or 6' substantially against the inner surface of the sleeve 5 or 5'. As a result of the nozzle-like construction of the sleeve 5 or 5[1], the flow of air at the terminal edge 10 or 10' realizes a high velocity and thereby atomizes the film of fuel arriving at the terminal edge in cooperation with the stream of air flowing through the annular air channel 9 or 9'. In this way, a good atomization of the fuel is achieved without the fuel being propelled too far radially outward. The stream of air conveyed by the outer air-feed device 11 or 11 is given a strong swirl by the swirl producers 12 and is greatly propelled radially outward as can be seen in FIG. 3. In this way, a stable recirculation flow 16 is produced in the combustion chamber 20, which fills up, without turbulence, even at the corners of the head of the flame tube 17. In this way, a good atomizing of the fuel is obtained and the spraying of the mist of fuel takes place preferably at a favorable angle 18 of between 50° and 80° with respect to the central axis of the fuel injection apparatus.

Although the invention has been described in relation to specific embodiments thereof, it will become apparent to those skilled in the art that numerous variations and modifications can be made within the scope and spirit of the invention as defined in the attached claims.

What is claimed is:

1. A fuel injection apparatus for a combustion chamber of a gas turbine for mixing fuel and compressed air and supplying the mixture to the combustion chamber, said apparatus comprising an injection nozzle for discharging fuel therefrom, a sleeve facing said nozzle in surrounding relation and including a tubular portion extending downstream of the injection nozzle, said nozzle being provided with circumferentially spaced radial injection openings facing said sleeve to discharge fuel onto the sleeve, said tubular portion projecting a substantial axial distance downstream of said nozzle such that fuel discharged from the nozzle forms a film of fuel on said tubular portion, inner and outer air-feed devices respectively encircling said sleeve internally and externally thereof for supplying inner and outer streams of air with opposite directions of swirl around the sleeve for atomizing the film of fuel, said sleeve including a tapered portion which merges with said tubular portion to form a nozzle, said injection nozzle projecting into said tapered portion of said sleeve, said tubular portion of said sleeve being axially displaced downstream of said injection nozzle, and a central air-feed device disposed between said inner and outer air-feed devices, said central air-feed device having an air channel whose cross section tapers in narrowing fashion in the direction of air flow in said air channel, said tubular portion of said sleeve having a terminal edge at which fuel is discharged, said central air-feed device having a narrowest cross section at the terminal edge of said sleeve to feed a stream of air externally of the sleeve and radially inside said outer stream of air from said outer air-feed device without turbulence around said terminal edge of the sleeve.

2. Fuel injection apparatus as claimed in claim 1, wherein said central air-feed device includes an outer wall including a portion extending concentrically around said sleeve in the vicinity of said terminal edge of the sleeve.

3. Fuel injection apparatus as claimed in claim 2 wherein said outer wall of the central air-feed device has a terminal edge which projects beyond the edge of the terminal edge of said sleeve.

4. Fuel injection apparatus as claimed in claim 1 comprising a swirl producing means operatively associated with said inner air-feed device located downstream of said injection nozzle.

5. Fuel injection apparatus as claimed in claim 4, wherein said sleeve includes a portion which tapers conically in narrowing fashion in the downstream direction and a cylindrical portion extending from the tapered portion only in the vicinity of said terminal edge.

6. Fuel injection apparatus as claimed in claim 4 wherein said sleeve includes a first portion which tapers conically in narrowing fashion in the downstream direction said tubular portion comprising a further portion extending in conically widening fashion from said first portion in the vicinity of said terminal edge.

7. Fuel injection apparatus as claimed in claim 4 wherein said inner air-feed device is shaped to convey the stream of air therein substantially in axial direction concentric to the injection nozzle.

8. Fuel injection apparatus as claimed in claim 4 wherein said central air-feed device includes an outer wall concentrically surrounding said sleeve to form an annular air channel for the central air-feed device, said outer wall initially tapering conically in narrowing fashion at a greater cone angle than the concentric inner sleeve so that said air channel of said central air-feed device has a substantial decreasing cross section in the direction of flow, said outer wall thereafter having a reduced cone angle such that said air channel then has only a slightly decreasing cross section.

9. Fuel injection apparatus as claimed in claim 1 comprising swirl producing means in said central air-feed device.

10. A method of injecting an atomized mixture of fuel and air into a combustion chamber of a gas turbine, said method comprising discharging fuel from an injection nozzle outwardly onto the inner surface of a sleeve around the nozzle to form a film of the fuel on the inner surface, advancing a first stream of air with a given direction of swirl into the sleeve, forming the sleeve with a reducing cross section to increase the velocity of the stream of air as it travels through the sleeve, conveying said film of fuel on said sleeve over a substantial distance to a discharge end of the sleeve located in axially displaced relation downstream of said injection nozzle, discharging the film of fuel at said discharge end of the sleeve with a direction of swirl as imparted by said first stream of air, conveying a second stream of air around the sleeve for discharge as an annular jet at the discharge end of the sleeve to atomize the fuel discharged thereat by a shearing action of the second stream against the first stream, reducing the flow cross section of the second stream of air as it advances to increase the velocity of the second stream of air at said discharge end of the sleeve, and conveying a third stream of air with a given direction of swirl for contact with the atomized fuel discharged from the sleeve to transport the atomized fuel into the combustion chamber.

11. A method as claimed in claim 10 comprising imparting a swirl to said third stream of air in a direction opposite to said first stream of air.

12. A method as claimed in claim 11 comprising conveying said second stream of air around the sleeve substantially without swirl.

13. A method as claimed in claim 12 comprising imparting the swirl to said first stream downstream of the injection nozzle.

* * * * *